US008007039B2

(12) United States Patent
Jeans

(10) Patent No.: US 8,007,039 B2
(45) Date of Patent: Aug. 30, 2011

(54) LIFTING MEANS

(76) Inventor: Edward Lewis Jeans, Llanwrda (GB)

( * ) Notice: Subject to any disclaimer, the term of this patent is extended or adjusted under 35 U.S.C. 154(b) by 489 days.

(21) Appl. No.: 11/274,815

(22) Filed: Nov. 15, 2005

(65) Prior Publication Data

US 2007/0132282 A1 Jun. 14, 2007

(51) Int. Cl.
*A47C 4/00* (2006.01)
*A47C 3/00* (2006.01)

(52) U.S. Cl. .. 297/16.1; 297/19; 297/284.2; 297/354.13

(58) Field of Classification Search ..... 297/16.1, 297/19, 284.2, 354.13, 452.13, DIG. 10; 5/81.1 C, 88.1
See application file for complete search history.

(56) References Cited

U.S. PATENT DOCUMENTS

| | | | | | |
|---|---|---|---|---|---|
| 280,004 | A | * | 6/1883 | Bakewell | 297/18 |
| 515,387 | A | * | 2/1894 | White | 297/52 |
| 545,741 | A | * | 9/1895 | Shutters | 5/88.1 |
| 654,221 | A | * | 7/1900 | Brodeur | 297/2 |
| 942,724 | A | * | 12/1909 | Flindall | 297/23 |
| 1,506,464 | A | * | 8/1924 | Alten | 297/299 |
| 1,521,904 | A | * | 1/1925 | Rhodes | 297/19 |
| 1,876,479 | A | * | 9/1932 | Weller | 297/19 |
| 2,080,761 | A | * | 5/1937 | Crawford | 297/452.13 |
| 2,697,476 | A | * | 12/1954 | Tripodi et al. | 297/18 |
| 2,855,025 | A | * | 10/1958 | Griffith | 297/19 |
| 3,123,395 | A | * | 3/1964 | Glass | 297/16.1 |
| 4,118,064 | A | * | 10/1978 | Robeson | 297/18 |
| 4,328,992 | A | | 5/1982 | Ohanian | |
| 5,806,910 | A | * | 9/1998 | DeRees | 296/63 |

FOREIGN PATENT DOCUMENTS

| | | |
|---|---|---|
| AU | 572376 | 5/1988 |
| AU | B-52568/86 | 5/1988 |
| EP | 1040777 A1 | 3/1999 |
| FR | 2298986 | 1/1975 |
| GB | 392153 | 11/1931 |
| GB | 392153 | 9/1932 |
| GB | 480314 | 2/1938 |
| GB | 713903 | 6/1953 |
| GB | 713903 | 8/1954 |

* cited by examiner

*Primary Examiner* — Sarah B McPartlin
(74) *Attorney, Agent, or Firm* — Head, Johnson & Kachigian, P.C.

(57) ABSTRACT

The invention relates to apparatus which can be used to move a person supported on the apparatus between a lying position in which the apparatus is substantially flat on a support surface and a seating position supported by the apparatus. The apparatus includes a frame which supports sheet material on which the person is supported. The apparatus can be moved between said conditions with the person supported thereon.

21 Claims, 3 Drawing Sheets

LIFTING MEANS

CROSS-REFERENCES TO RELATED APPLICATIONS

N/A

STATEMENT REGARDING FEDERALLY SPONSORED RESEARCH OR DEVELOPMENT

N/A

INCORPORATION BY REFERENCE OF MATERIAL SUBMITTED ON A COMPACT DISC

N/A

BACKGROUND OF THE INVENTION

The invention relates to the provision of apparatus which can be used to lift and seat a person, the apparatus being movable between at least two positions, a substantially flat condition and a substantially erected condition with the seat being usable to support a person in either of the positions and, as the same moves between the said positions, thereby allowing the seat to be selectably used as a seating means and also a moving means to move a person from a position substantially in line with the plane of a surface to a position raised above said surface and in a seated condition.

With elderly, disabled and/or infirm persons, there can be a need to provide a seating apparatus for them and also additional apparatus which allows them to be moved from a lying or lowered condition to a raised seating position. Conventionally, such apparatus can comprise an inflatable means which allows the person to be raised but then transferred from that position to a seat. This can cause injury to persons assisting and/or discomfort to the person themselves. Alternatively, the person is required to remain on the lifting apparatus but, as the lifting apparatus is primarily and conventionally provided to perform the lift, the user can experience discomfort when in the seating position on said lifting apparatus which can often be bulky and/or may be unstable.

BRIEF SUMMARY OF THE INVENTION

The aim of the present invention is to provide apparatus which allows the movement of a person from a position on or substantially adjacent a surface to a seating position by apparatus which can also be used to form a seat on which the person is mounted following the lifting operation. It should also be appreciated that the lifting operation can be reversed to lower the person from the seated position to a surface.

In accordance with the present invention there is provided apparatus which can be moved between an erected position and a collapsed position substantially adjacent the surface on which the same is mounted, said apparatus including a frame having legs, and a back portion, and sheet material suspended between members of the frame and by which a person is supported, characterised in that movement means are provided which allow selective movement of the apparatus so as to allow movement of the apparatus between said conditions.

In one embodiment the back portion comprises a top part and a bottom part, said parts, at least prior to the movement of the frame from the flattened to the chair position being provided in a relatively angled configuration to allow the apparatus to be encouraged to move from the flattened condition.

In one embodiment the back portion is provided with said parts in a permanently angled configuration.

In an alternative embodiment the parts of the back portion can be selectively angled by the user. In this embodiment the said parts can be moved to a straight in-line non-angled configuration when the apparatus is in the flattened condition.

Preferably, the movement between the said conditions is achievable such that the apparatus can be moved from the flattened or collapsed condition to the erected condition with the person in position on the apparatus and thereby allowing the person to be moved from the lying to a seating position as the apparatus is moved from its collapsed to erected conditions. In one embodiment the reverse movement can occur with the person on the apparatus although this is not as important a feature. In one embodiment the movement means acts on the sheet material such that the sheet material causes the movement of the members. Alternatively, movement means could be a chain, cord or other member and the sheet material folds or stretches in response to the apparatus movement.

In one embodiment, one end of the sheet material is attached to a member of the frame on which the movement means act, which is movable to wind the sheet material around same so that when in a relatively unwound condition, the seat is in a collapsed position and subsequent winding of the sheet material causes the seat frame to move to the erected condition in which the seat itself is formed for use.

Preferably the sheet material passes around a plurality of members as it passes from one member which is attached to the member on which the movement means acts. Typically the seat material passes from the top of the back of the seat to the front member of the base of the seat. Preferably each of the members over which the sheet material passes is provided with a roller.

Although it is possible that any of a number of suitably positioned members can be used to wind the sheet material, a member mounted at the top or adjacent the top of the back support of the seat is found to be advantageous mechanically if used as the member to wind the sheet material, with the other end of the sheet material being held in a fixed position with respect to another member.

Typically the leg members of the seat are interconnected and pivoted so as to act in a scissor-like fashion. Preferably the leg members are shaped so as to be nested when the seat is in the flattened position thereby allowing the seat to be positioned as close to the surface as possible and allow a person to be moved easily from the surface onto the seat sheet material.

In one embodiment the apparatus includes first and second portions such as a back portion and a seat portion or two portions of the back portion and said portions are provided in an angled relationship when in the collapsed condition prior to movement of the apparatus to an erected position.

In one embodiment the portions are provided in a fixed angular position when in the collapsed position.

In an alternative embodiment the portions can be selectively moved between a substantially flat in-line position and the angled position whilst in the collapsed condition to thereby ease the movement of a person on and off the apparatus and then subsequently to allow the movement of the apparatus to the erected position with the person supported by the same.

Preferably, said sheet material movement means can be locked in an engaged position when the seat is in a flattened and/or seating position, and/or an angled position therebetween and typically by a ratchet mechanism, so as to retain the same in that position and minimise any risk of injury to a person due to unexpected movement of the seat mechanism.

In one embodiment, the movement means can be manually actuated by the provision of a handle which, upon turning, causes the movement of the sheet material as required in the required direction. Alternatively, powered means can be provided in attachment to the control means which can be actuated by the user on the seat or another person, typically by button operated control means. In this embodiment, the power supply for the seat can either be a mains connection or may be provided as part of the seat itself.

In use, to commence movement from the flattened to erect position, the movement means acts on a member to move the sheet material which in turn causes a member to pivotally move the leg members apart such that further movement of the sheet material causes the pivotal movement of the legs.

In one embodiment a movement initiating member is provided whose purpose is to commence the lifting movement and act on the other members to initiate movement.

In one aspect of the invention there is provided a seat lifting means for a person, said means movable to raise or lower a person, said person supported by sheet material as the lifting means moves between a position to allow the person to be in a lying position adjacent a surface on which the lifting means is placed and a position to allow the person to be in a seated position.

In a further aspect of the invention there is provided a lifting device for the support of a person between lying and seated positions, said device including a framework comprising a series of members and a sheet material supported by the members, said device movable about a pivotal axis formed intermediate the ends of the frame and which allows the frame members forming the top part of the back portion to one side of the pivotal axis to move between a substantially horizontal plane and a plane other than horizontal and wherein the pivotal axis is provided with at least one ratchet mechanism, said mechanism having a first movement which allows the movement of the top part of the back portion between substantially in line and angled positions and in which position the part can be selectively retained by the ratchet mechanism In one embodiment the pivotal axis with the ratchet moves in response to a manual force provided on the back portion to move the top end of the back portion between angled and flattened positions with respect to the bottom end of the back portion.

In one embodiment a ratchet mechanism is provided at each edge of the pivotal axis.

The ratchet mechanism can include a first rotational part and a second rotational part provided with a series of stepped portions for selective engagement by a ratchet pin.

Typically the bottom or leg end of the back portion is connected to the first rotational part and the top end of the back portion is connected to the second rotational part.

In one embodiment the provision of the ratchet mechanism allows the back portion to lie in a flat position with the seat portion with one inside the other thus allowing the device when in the substantially flat position to have a significantly flat configuration thereby allowing the device to be more easy for a person to get on and off. The ratchet mechanism allows the top end and bottom ends of the back portion to be angularly adjusted to thereafter allow the seat and back portions to be moved to the erected condition while the person remains on the sheet material and the ratchet allows the angular adjustment to be maintained.

BRIEF DESCRIPTION OF DRAWINGS

Specific embodiments of the invention are now described with reference to the accompanying drawings, wherein.

BRIEF DESCRIPTION OF DRAWINGS

Figure 1:
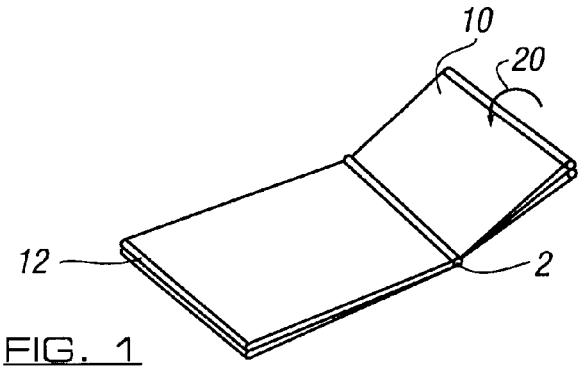
FIG. 1 illustrates a perspective view of the seat in a first embodiment in accordance with the invention in a flattened condition.
Figure 2:
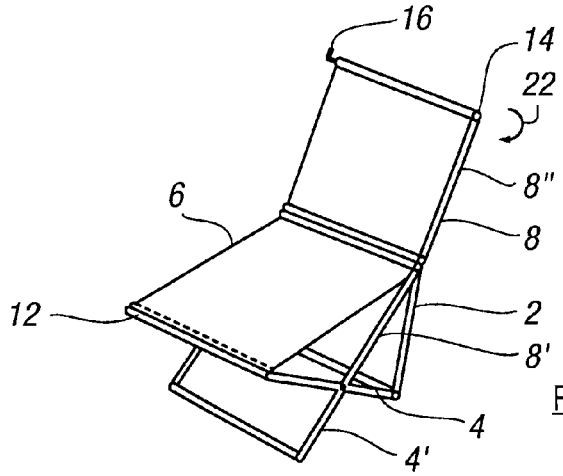
FIG. 2 illustrates the seat in accordance with the embodiment of FIG. 1 in an erected condition.

Referring firstly to FIGS. 1 and 2, there is illustrated a seat in accordance with the invention in two different conditions and it should be appreciated that movement between the conditions is possible while a person remains supported by the apparatus.

The seat comprises a frame 2 which has leg members 4 connected to member 12 to form a seat portion 6, and leg members 4' connected and angled to form the bottom part 8' of the back portion 8 which includes a top portion 8", and actuating member 29 pivoted at point 36. Suspended between members of the frame is a sheet material 10. The sheet material is attached at one end in a fixed position with a member 12 of the frame and the opposing end of the sheet material is attached around a rotatable member 14. The member 14 is provided to around a rotatable member 14. The member 14 is provided to rotate and is provided with movement means, as an example in FIG. 2 illustrated by a manual movement handle 16, although this could, and may preferably be, automated so as to allow operation by a person when sitting on the seat via remote control operation of the drive means (not shown). In any case, rotation of the member 14 in the direction shown in FIG. 1 by arrow 20 causes winding in of the sheet material, and causes the sheet material to act on members of the seat frame and hence causes the seat to move to the erected position shown in FIG. 2 with the person supported by the sheet material moving from a lying to a seated position. When in the position of FIG. 2, rotation of the member 14 in the reverse direction 22 causes the seat to move back to the position shown in FIG. 1.

Figure 3:
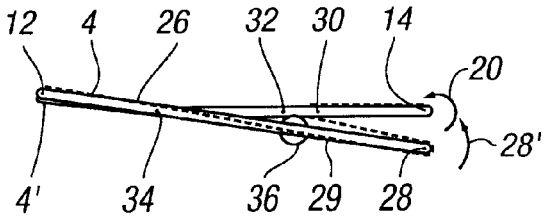
FIG. 3 illustrates a schematic view of the seat of the embodiment of FIGS. 1 and 2 of the invention showing the frame of the seat in a collapsed condition.
Figure 4:
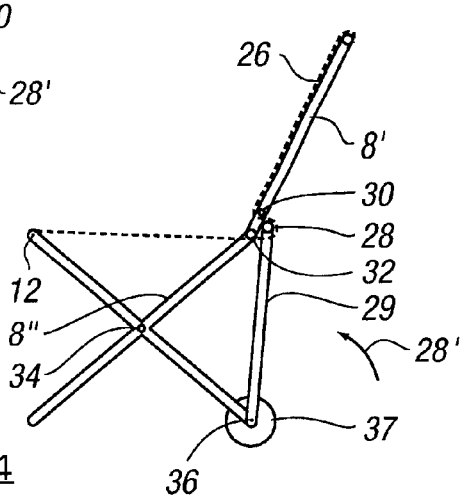
FIG. 4 illustrates a schematic view of the frame of the seat in the embodiment of FIG. 3 in a seating position.

In FIGS. 3 and 4, the frame of the seat is shown in detail with the sheet material removed but the path of the sheet material shown by broken lines 26. It can be seen how the sheet material passes from the fixed position on member 12 around the actuating member 28, to a second member 30 to the movement means member 14. Rotation of the movement means member 14 in the position of FIG. 3 in accordance with arrow 20 causes the sheet material to initially tighten around the respective members and firstly drawn up actuating member 29 as indicated by arrow 28'. The top and end parts, 8', 8' of the back portion 8 are angled at location 32 and therefore provide the initial angle to force the apparatus to the seating position. This causes the leg members 4, 4' to move apart from the rested position about pivot point 34. Once apart the operation of the movement means causes the leg members 4, 4' to further pivotally move and thus bring the chair and person thereon to a seated position as shown in FIG. 4.

The separation of the legs 4, 4' has to take place in the process of movement by pulling member 28 closer to member 30 so that the movement does not pull against the pivot point 34.

In one embodiment the gearing of the respective members can be altered to suit movement requirements by altering the diameters of the members 14, 28, 30, 32 as required, all by provision of a gearing mechanism at 14.

If required, an ancillary rigid or cushioned base can be placed onto the sheet material in seating or lying position.

When erected the member 32 also contacts the sheet material as indicated.

Wheels or rollers can be provided as required, to improve the movement of the apparatus, typically rollers are provided on these members which contact with the sheet material, 30, 28, 32. Wheels 37 can also be provided as indicated in FIGS. 3 and 4.

Figure 5:
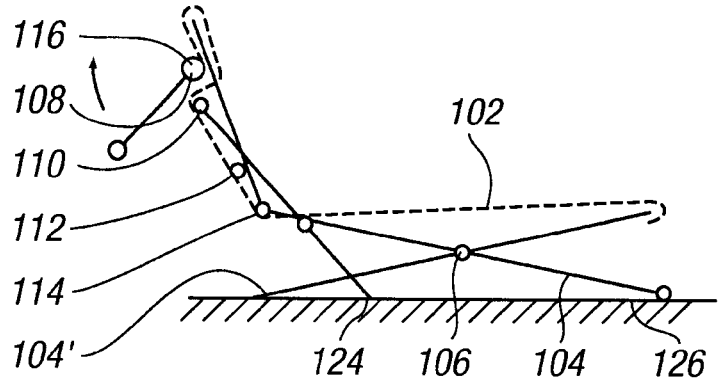
FIGS. 5-7 illustrate a further embodiment of the invention.
Figure 6:
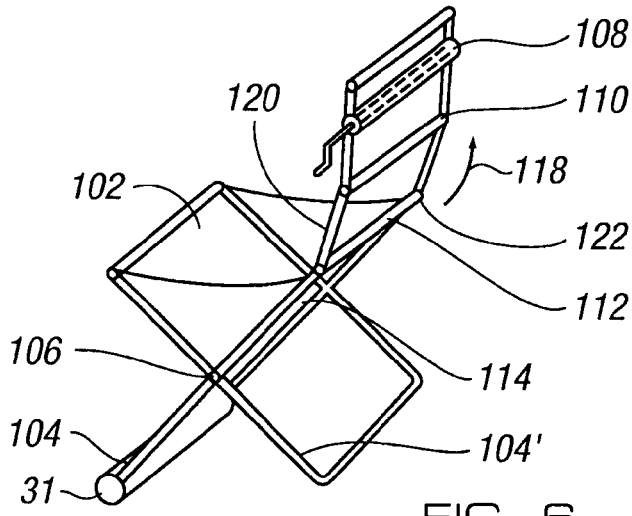
Figure 7:
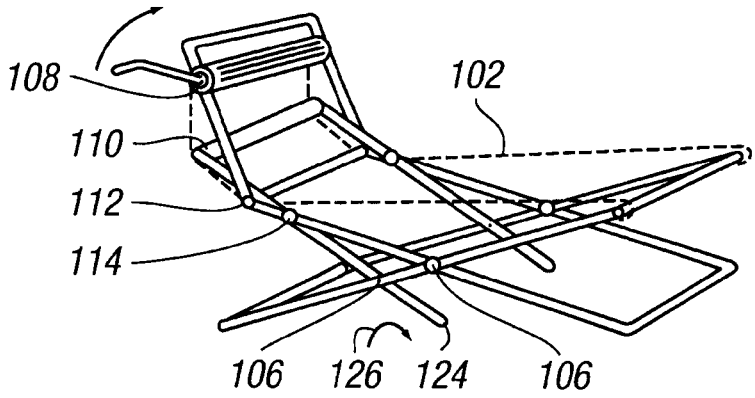

FIGS. 5-7 illustrate a further embodiment of a lifting seat in accordance with the invention.

The seat again comprises a sheet material 102 suspended by a frame comprising leg members 104, 104' which are pivotally movable about pivot axis 106, rotary member 108 about which the sheet material is wound and unwound to raise and lower the seat respectively as in the previous embodiment and intermediary rollers 110, 112, 114 about which the sheet material passes.

In this embodiment the initial movement of the seat between the lowered position and erected position is again initiated by rotation of the actuator 116 which starts to wind in the sheet material and which, in turn, acts on the lift initiating member 110. This arm then moves to a position as indicated by arrow 118 to act on the members 112, 114. This action moves these members forward and in turn pivotally moves the leg members 104, 104' about pivot axis 106 as the opposing end 124 of the lift initiating member 110 contacts the supporting surface 126 at the same time. This effectively releases the member for subsequent movement such that further winding in of the sheet material causes movement of the frame members in the manner described with respect to FIGS. 1-4.

Figure 8:
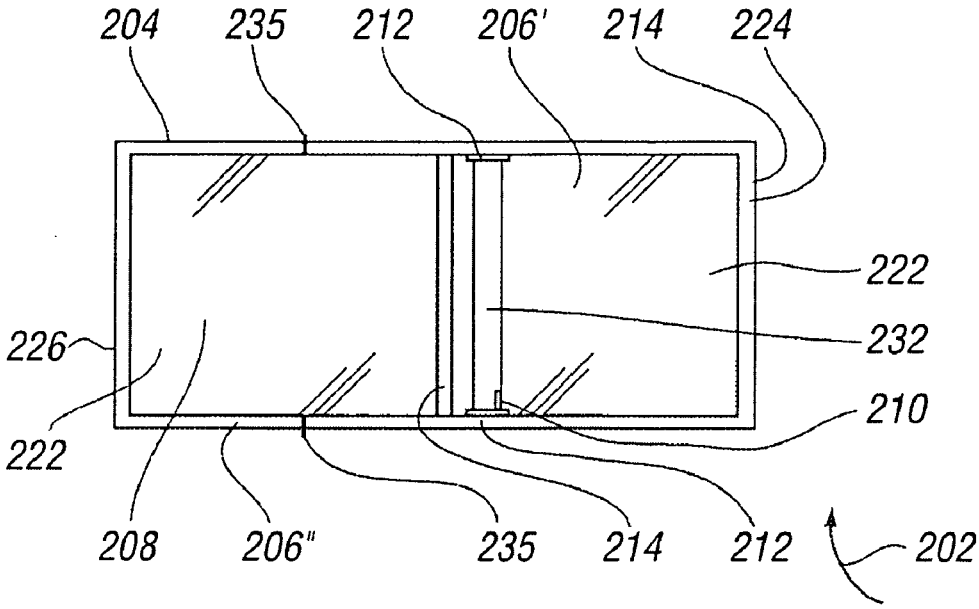
FIGS. 8-10 illustrate a further embodiment of the invention incorporating a ratchet mechanism.
Figure 9:
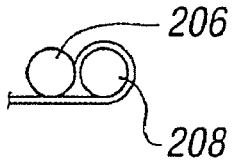
Figure 10:
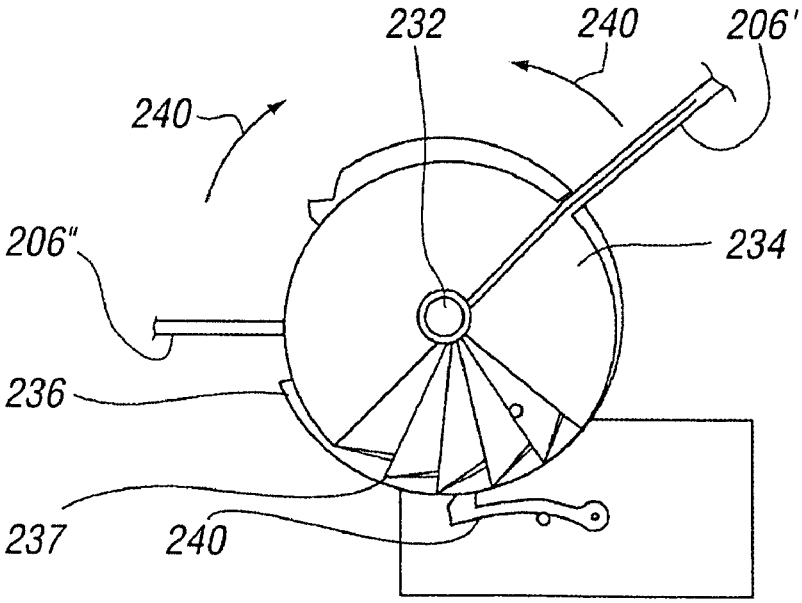

Referring now to FIGS. 8-10 the device 202 in this embodiment includes a frame 204 which has a back portion 206 and a seat portion 208 as previously described with leg portions which pivot about location 235. However in this embodiment the back portion is formed of a top part 206' and a bottom part 206" joined at a pivotal location 232 which includes at each end a ratchet mechanism 212 in accordance with this embodiment. A flat tie bar 214 is provided.

In contrast to the previous embodiments where the angular arrangement of the parts of the back portion is fixed, the top and bottom portions 206', 206" are angularly adjustable about pivot 232 and therefore can be moved by the user to lie substantially flat in the flattened condition of the apparatus on the support surface and are provided to be pivoted selectively about the pivotal location 232. As a result of this the frame as a whole is flatter than the previous embodiments as the back portion is split into the top and bottom portions which can pivot to the flat position. The frame members can also nest within each other as indicated in FIG. 9 therefore further improving the "flatness" of the apparatus and easing the lifting on and off of a person.

The sheet material 222 is suspended between the frame ends 224,226 and wraps around the pivotal axis 232 and the flat tie bar in the same manner as previously described.

In this embodiment, in order to move the apparatus to the seating position with a person on the sheet material when in a flat position there is a need to firstly move the top and bottom portions 206', 206" of the back portion from the flat in line position to an angled configuration similar to that shown for the back portion 8 and parts 8',8" of the first embodiment which is not adjustable, as shown for example in FIG. 4. In order to achieve this the ratchet mechanism 212 shown in more detail in FIG. 10 includes a first rotatable part 234 and a second rotatable part 236 mounted for rotation about axis 232. One rotatable part 234 is connected to portion 206' and the other is connected to portion 206". When the movement to the seating position from the flat position is required, the first step is to move the ratchet so that the portion 206' takes up an angled position with respect to part 206" such as shown in FIG. 10 by rotation about axis 232. The part 206' is then held in that position as the part 234 includes a series of stepped portions 237 for selective location with a pin 240 resiliently mounted on the frame and which is pivotable, typically under the influence of a spring, to follow and engage with the stepped portions as the same rotate. This therefore acts, when rotation of the ratchet mechanism stops, to lock the portion 206' in the angular position. From there the rotation of the member 214 and movement of the sheet material can then cause the raising of the apparatus to the seating position in the manner as previously described with the other embodiments.

To move the apparatus to a flattened condition or to store it folded, the ratchet is reset by rotation of the portions 206', 206" as indicated by arrows 240 towards each other to disengage the pin via the contact of the disc 236.

Thus the present invention provides apparatus which acts as a seat and lifting means in one item of apparatus. Although designed mainly for use in the movement of elderly and/or infirm persons between lying an raise sitting positions, it should be appreciated that the invention described herein may have many other applications such as leisure uses where the provision of a collapsible but raisable seat would be deemed to be desirable. The seat can also be designed to suit specific uses, such as, for example, taking into account the length of time which a person would be expected to sit on the same in any one go.

While the invention has been described with a certain degree of particularly, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

The invention claimed is:

1. Apparatus movable between an erected condition and a substantially flattened collapsed condition substantially adjacent a supporting surface on which the same is mounted, said apparatus comprising:

a frame having a plurality of members, leg members having pivot points, and an actuating member having a pivot point;

sheet material suspended between the leg members and the actuating member of the frame and by which a person may be supported, the sheet material being attached at one end to a rotatable member of said frame on which a movement means acts and another end of the sheet material is attached to one of the leg members or actuating member in a fixed position;

movement means are provided which allow selective movement of the apparatus between said erected and collapsed conditions by acting on the sheet material while said apparatus provides support to the person thereon so as to move the person between a lying position when the apparatus is in the collapsed condition and a substantially seated position when the apparatus is in the erected condition; and wherein a portion of said sheet material passes around and acts on the actuating member to pivot one end of the actuating member toward the supporting surface and another end of the actuating member is drawn upwardly to initiate movement of the apparatus when the sheet material is wound up by the movement means and commences the movement of the leg members from the flattened collapsed condition to the erected condition.

2. Apparatus according to claim 1 wherein said movement means acts on said sheet material such that said sheet material causes movement of said leg members.

3. Apparatus according to claim 1 wherein said movement means is selected from the group consisting of a chain; and cord and said sheet material folds or stretches in response to the apparatus movement.

4. Apparatus according to claim 1 wherein said sheet material is attached to the rotatable member of said frame on which said movement means acts, the rotatable member of said frame movable to wind said sheet material around said rotatable member so that when in a relatively unwound condition, said apparatus is in the collapsed condition and winding of said sheet material causes one or more of the leg frame members or actuating member to move to the erected condition in which an apparatus is formed for use as a chair.

5. Apparatus according to claim 4 wherein said sheet material passes around at least one of said leg members and said actuating member.

6. Apparatus according to claim 5 wherein said sheet material passes from a top of a back portion of said apparatus to a front of a base of said apparatus.

7. Apparatus according to claim 4 wherein each of the leg members or actuating members over which said sheet material passes is provided with a roller.

8. Apparatus according to claim 1 including first and second portions, said portions provided in an angled relationship when in said collapsed condition prior to movement of said apparatus to the said erected condition.

9. Apparatus according to claim 8 wherein said first and second portions are provided in a fixed angular position when in said collapsed condition.

10. Apparatus according to claim 8 wherein said first and second portions can be selectively moved between a substantially flat in-line position in the collapsed condition to the angled relationship, to thereby ease movement of a person on and off said apparatus and then subsequently move said apparatus to the erected condition with the person supported by the same.

11. Apparatus according to claim 1 wherein a member mounted at a top or adjacent the top of a back support of a scat is used as the rotatable member to wind one end of said sheet material, with another end of said sheet material being held in a fixed position with respect to at least one of said leg members or said actuating member.

12. Apparatus according to claim 1 wherein said leg members are interconnected and pivoted together at a point intermediate between ends of the leg members.

13. Apparatus according to claim 1 wherein the sheet material movement, means can be locked in an engaged position when the seat is in the collapsed condition and/or erected condition.

14. Apparatus according to claim 1 wherein said movement means includes a handle which, upon turning, causes movement of said sheet material in a required direction.

15. Apparatus according to claim 1 wherein powered means are provided in attachment to said movement means which can be actuated by the user on the apparatus or another person, typically by control means.

16. Apparatus according to claim 1 wherein to commence movement from said collapsed condition to said erected condition, said movement means acts on the rotatable member to move said sheet material which in turn causes the actuating member to pivotally move said leg members apart and movement of said sheet material causes pivotal movement of said leg members.

17. Apparatus according to claim 1 wherein said back apparatus includes a portion including a top part and a bottom part, said parts, at least prior to movement of said frame from the collapsed condition to the erected condition, being provided in a relatively angled configuration to provide a pivot point to allow said apparatus to move from the collapsed condition to the erect condition.

18. Apparatus according to claim 17 wherein said back portion is provided with said top part and said bottom part in a permanently angled configuration.

19. An apparatus according to claim 1 wherein the pivot point of said actuating member is located at one end of the actuating member.

20. An apparatus according to claim 19 wherein the pivot point of the actuating member includes a roller.

21. A lifting means for a person, said lifting means comprising:

a frame having a plurality of members, leg members having pivot points, and an actuating member having a pivot point;

a back portion having a top part and a bottom part, said parts being in a relatively angled configuration;

sheet material suspended between the plurality of members of the frame and being attached at one end to a rotatable member of said frame on which a movement means acts and another end of the sheet material being attached to one of the plurality of members in a fixed position;

movement means for selectively moving the apparatus between an erected and a flattened collapsed condition by acting on at least one of the plurality of members to move the sheet material which in turn causes the actuating member to pivotally move the leg members apart such that further movement of the sheet material causes pivotal movement of the legs; and wherein a portion of said sheet material passes around and acts on the actuating member to pivot one end of the actuating member towards the supporting surface on which the lifting means is mounted and another end of the actuating member is drawn upwardly towards a frame member to initiate movement of the apparatus when the sheet material is wound up by the movement means and commences the movement of the leg members from a flattened collapsed condition to the erected condition.

* * * * *